United States Patent [19]

Kreth et al.

[11] Patent Number: 4,669,363

[45] Date of Patent: Jun. 2, 1987

[54] HYDRAULIC PRIORITY CONTROL MEANS FOR AT LEAST TWO SERVO MOTORS

[75] Inventors: Norbert Kreth; Peter Büttner, both of Lohr/Main, Fed. Rep. of Germany

[73] Assignee: Mannesmann Rexroth GmbH, Lohr/Main, Fed. Rep. of Germany

[21] Appl. No.: 738,837

[22] Filed: May 29, 1985

[30] Foreign Application Priority Data

Jun. 8, 1984 [DE] Fed. Rep. of Germany ..... 3421502

[51] Int. Cl.[4] ..... F15B 11/16

[52] U.S. Cl. ..... 91/516; 91/189 R

[58] Field of Search ..... 91/426, 451, 452, 511, 91/516, 189 R; 60/422

[56] References Cited

U.S. PATENT DOCUMENTS 2,892,311 6/1959 Van Gerpen .

4,074,529 2/1978 Budzich ..... 60/452

4,124,333 11/1978 Liesener ..... 417/218

*Primary Examiner*—Samuel Scott

*Assistant Examiner*—Noah Kamen

*Attorney, Agent, or Firm*—Harness, Dickey & Pierce

[57] ABSTRACT

The invention relates to a priority control means with which the actuation sequence of two servo motors can be automated. For this purpose a priority control valve is provided which on actuation of the higher priority control valve immediately blocks the lower priority servo motor. If the priority servo motor has reached a certain position the associated control valve is automatically switched back so that the actuation of the lower priority servo motor then follows automatically. Via a changeover valve the working pressure of the respective servo motor is furthermore automatically switched to the pump control of an adjustment pump or, with a constant pump, to the load-pressure-dependent pressure control so that a load-dependent regulation takes place.

11 Claims, 2 Drawing Figures

HYDRAULIC PRIORITY CONTROL MEANS FOR AT LEAST TWO SERVO MOTORS

BACKGROUND OF THE INVENTION

The invention relates to a hydraulic priority control means for at least two servo motors.

Such a priority control means is known, see for example DE-PS No. 2,335,704. In the latter, the priority control valve is influenced selectively by the control pressure tapped off at the higher priority or lower priority control valve depending on which pressure is higher.

The present invention is based on the problem of providing with the simplest possible means a priority control which automates the successive fluid driving of two servo motors.

SUMMARY OF THE INVENTION

A substantial facilitation of operation is obtained in so far as for initiating the movement cycles of the two servo motors through the actuation of the associated control valves. However, fluid is supplied only to the higher priority servo motor because the flow of fluid to the lower priority servo motor is immediately shut off by the priority control valve. As soon as the higher priority servo motor reaches a predetermined position the associated control valve can be automatically returned to the neutral position so that the movement cycle of the lower priority servo motor can immediately take place. Via a changeover valve, in each case, the working pressure of the respective servo motor is applied as control pressure to the regulating means of the adjustment pump or to the load-pressure-dependent pressure regulation when using a constant pump. Thus, the displacement volume of the adjustment pump can be regulated in dependence upon the load or the remaining oil flow can be led to the tank when using a constant pump. The control according to the invention is thus of very simple structure and distinguished by low constructional expenditure.

Preferably, the priority control valve and the changeover valve are combined in a centre valve block closed on either side by a valve block for the higher priority and lower priority control valves. In this manner no tube connections at all are necessary between the valve blocks.

BRIEF DESCRIPTION OF THE DRAWINGS

Two examples of embodiment of the invention will be explained hereinafter with the aid of the drawings in which a priority control means for two servo motors is diagrammatically illustrated.

DETAILED DESCRIPTION OF THE PREFERRED EMBODIMENTS

Figure 1:
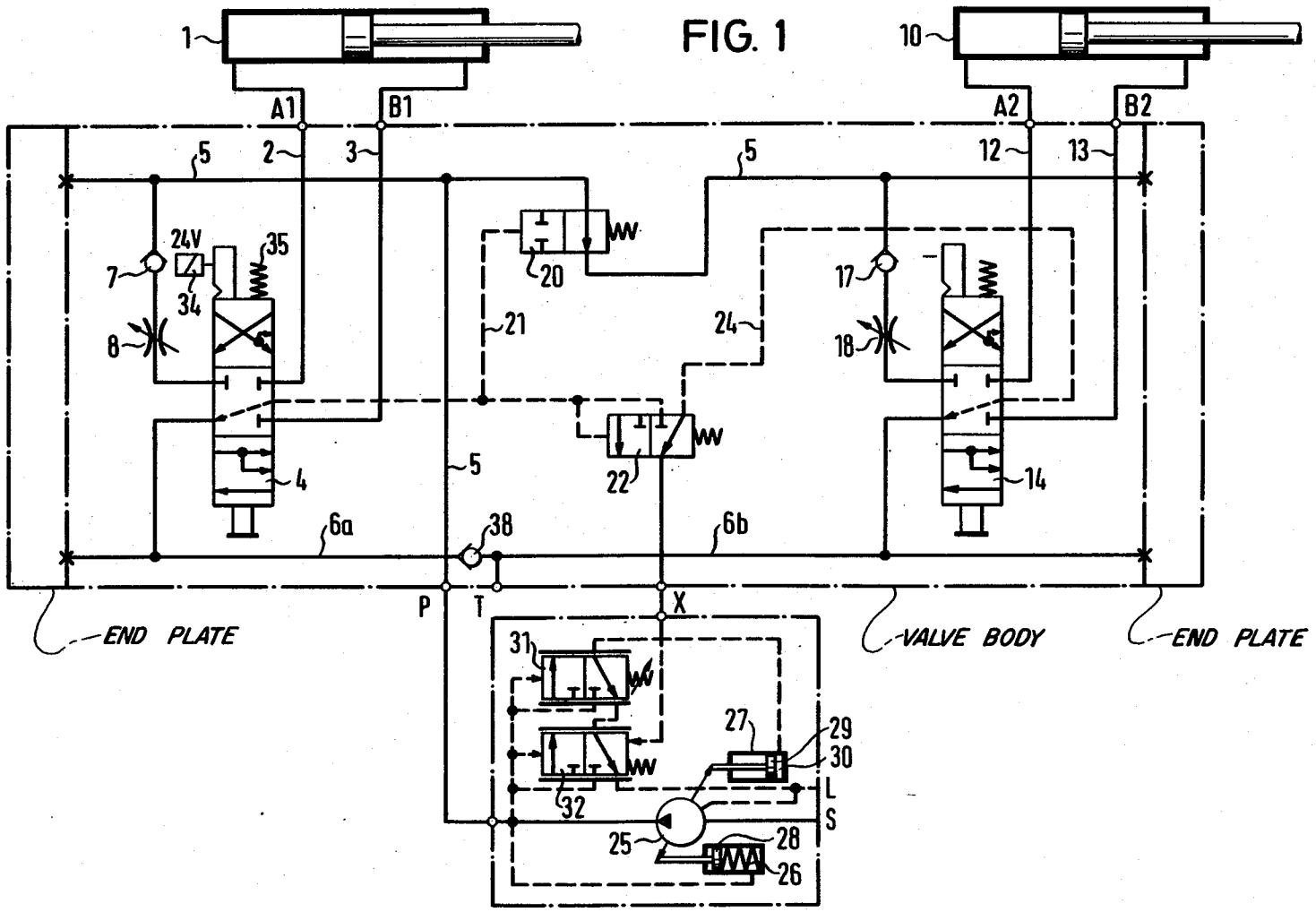
FIG. 1 illustrates the embodiment in connection with the use of a variable displacement pump as a power source.

In the Figures the higher priority servo motor 1 is connected via working lines 2 and 3 and a control valve 4 to a pump pressure line 5 or to a line **6*a* leading to a tank connection T which is connected in an appropriate manner to a tank or reservoir (not shown in FIG. 1). Between the pump pressure line 5** and the control valve

4 a load hold check valve 7 and adjustment throttle 8 is provided.

The lower priority servo motor 10 is also connected via working lines 12 and 13 and a control valve 14 to the pump pressure line 5 and to the line **6*b* leading to the tank connection T. Between the control valve 14 and the pump pressure line 5 a load hold check valve 17 and an adjustment throttle 18** are likewise provided.

The higher priority servo motor in the examples of embodiments explained here is the drive for adjusting the blade of a wheel loader whilst the lower priority servo motor 10 represents the drive for the vertical adjustment of the blade for raising and lowering. For raising material the blade of the wheel loader must be pivoted out of a position in which the blade picks up material (a forwardly inclined opening) into a position in which the opening is directed upwardly. This blade adjustment is effected by the servo motor 1, whereas the blade is raised by the servo motor 10 to load a vehicle. It is thus obvious that the raising by means of the servo motor 10 must not take place until the blade has been moved by the servo motor 1 into the end position in which the blade opening is directed upwardly.

For this purpose a priority control valve 20 is provided which either opens or shuts off the flow of pump fluid to the control valve 14 for the lower priority servo motor 10. The switching of the priority control valve 20 takes place dependent upon the control pressure in a controlled pressure line 21 which is led to the control valve 4. The line 21 is connected in the illustrated neutral position of the control valve to the tank line **6*a* whilst on deflection of the control valve the control pressure line 21 is connected respectively to the working pressure in the working line 2 or 3**.

Furthermore, the control pressure line 21 is connected to a changeover valve 22 which dependent upon the control pressure connects either the control pressure line 21 or the control pressure line 24 leading to the control valve 14 to the connection X. In the illustrated neutral position of the control valve 14 the control pressure line 24 is also connected to the tank line **6*b* whilst on deflection of the control valve out of the neutral position into one of the working positions the working pressure existent in the respective working lines 12 and 13 acts on the control pressure line 24 as control pressure. The pump pressure line 5 is connected via the connection P in the embodiment of FIG. 1 to an adjustment pump 25, for example an axial piston adjustment pump of swash plate design in which the swash plate is clamped in the manner illustrated between two adjustment cylinders 26 and 27. The swash plate is adjusted by the smaller piston 28 through a spring and by the pump pressure in the direction of the largest adjustment angle and thus the largest displacement volume. The larger piston 29 of the adjustment cylinder 27 adjusts the swash plate in contrast dependent upon the pressure in the cylinder chamber 30** in the direction towards the smallest displacement volume.

For setting the pressure in the cylinder chamber 30 a pressure regulating valve 31 and a regulating valve 32 defining the delivery flow are provided.

At the pressure regulating valve 31 an adjustable spring sets the maximum pump pressure desired in the system. The pump pressure acts oppositely to the spring on the valve 31. The pressure regulating valve 31 is thus adjusted by the difference between the set pressure and the actual pump pressure and connects the cylinder chamber 30 either to the tank connection T or to the pump pressure line 5. The pressure regulating valve thus keeps the pressure in the pump pressure line constant. The adjustable pump 25 thus delivers only as much fluid as is taken up by the servo motors 1 and 10. It is apparent for example from the illustration that with increasing pump pressure the valve 31 is displaced to an increasing extent from the position illustrated so that the cylinder chamber 30 is increasingly subjected to the pump pressure and consequently the swash plate is pivoted back to a smaller adjustment angle in which the delivery flow is reduced.

The regulating valve 32 supplements the function of the pressure regulating valve 31 and serves to adjust the delivery flow of the pump. For this purpose the regulating valve 32 is adjustable in response to the differential pressure between the pump pressure of the pressure line 5 and the respective control pressure at the connection X. As already explained this control pressure corresponds to the working pressure at the servo motor 1 or 10. Thus, depending upon this pressure difference the valve 32 is also adjusted so that the cylinder chamber 30 is subjected to pump pressure or relieved to the tank. Thus, the delivery flow of the pump is set so that a predetermined pressure difference between the pump pressure and the control pressure is kept constant, i.e. the adjustment rate of the servo motors is kept constant independently of the working pressure. Further details of the regulation for the adjustment pump will not be explained because this is a known control, i.e. a combined pressure-delivery flow regulator.

Figure 2:
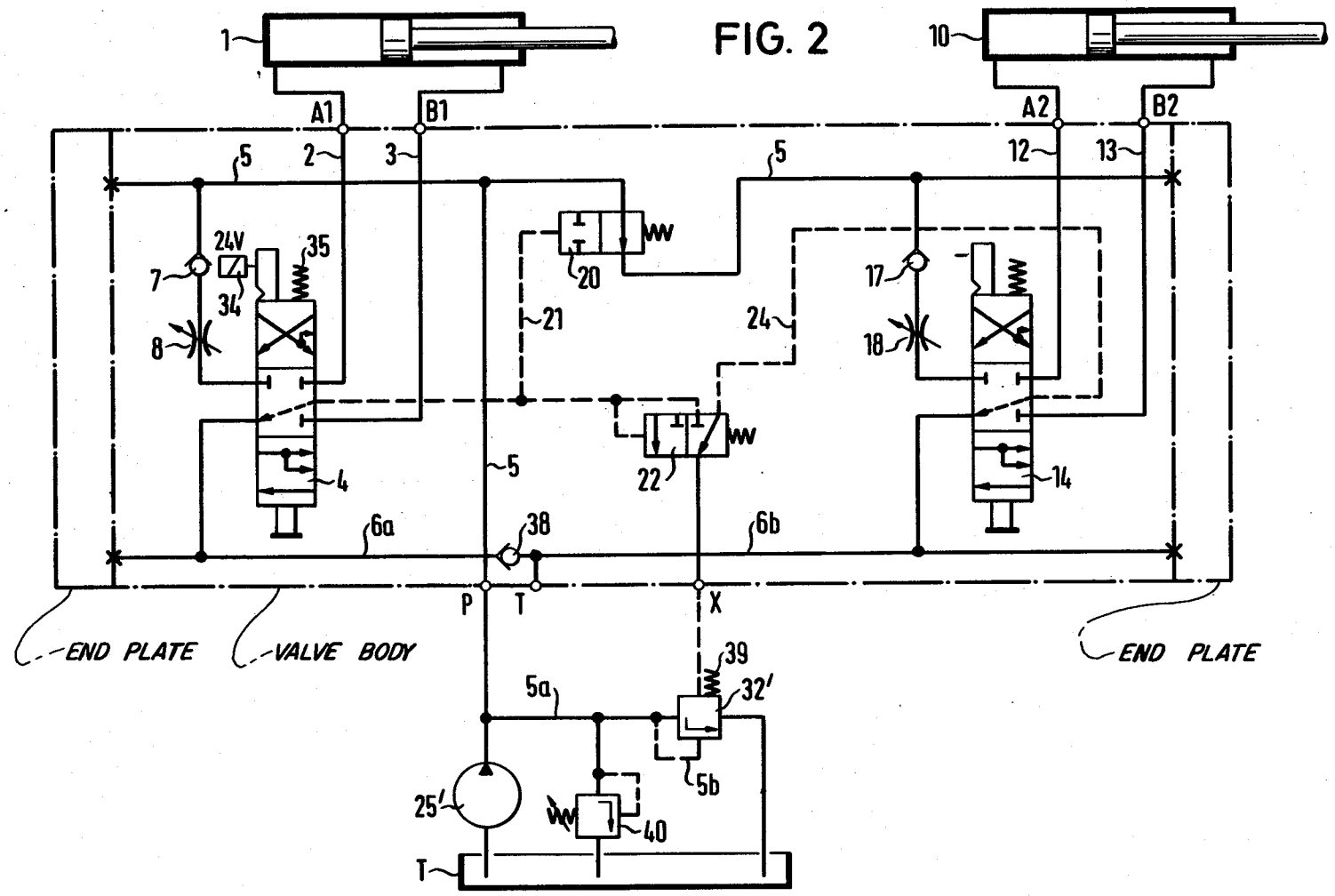
FIG. 2 illustrates an embodiment incorporating a constant displacement pump as a fluid source.

For load-dependent pressure regulation of a pump 25' with constant displacement volume as in the embodiment of FIG. 2 the regulating valve 32' is disposed in a bypass line **5*a* which leads from the pressure line 5 of the pump 25' to the tank T. In the initial position illustrated of the control valves 4, 14 the connection from the pump 25' to the servo motors 1, 10 is blocked and the control line 21, 24 is relieved to the tank so that the control valve 32' disposed in the bypass line 5*a* is subjected only to the small force of the spring 39 in the closure direction. For the circulation of the working fluid from the pump 25' to the tank T via the bypass line 5*a* it is therefore only necessary for a small pump pressure acting in the bypass line 5*a* and the control line 5*b* to build up. This small pressure need only overcome the small closure force of the spring 39**.

If a servo motor 1, 10 on actuation of one of the control valves 4, 14 is switched to one of its operating positions the load pressure arising is applied exactly as in the example of embodiment according to FIG. 1 to the regulating valve 32' via the control lines 21, 24. Thus a correspondingly high closure force is generated at the regulating valve 32', resulting in a corresponding increase in the pump pressure. The working agent not required by the consumer 1, 10 is conducted via the regulating valve 32' to the tank T. The pressure difference occurring at the control valve 4, 14 is kept constant independently of the load pressure achieved by the regulating valve 32'. Thus also as in the example of embodiment according to FIG. 1 the adjustment rate of the servo motors is kept constant for a given control position of the control valves 4, 14. The pressure difference arising at the control valves 4, 14 is defined by the force of the spring 39 of the regulating valve 32'.

A pressure-limiting valve 40 serves to protect the system and is therefore set to an appropriate value.

The mode of operation of the priority control in each embodiment is as follows: as soon as the control valve 4 for the higher priority servo motor 1 is deflected from the illustrated neutral position to the working position in which the blade is pivoted for picking up the load material and the control pressure corresponding to the working pressure of the servo motor is exerted in the control pressure line 21. This control pressure acts on the priority control valve 20 causing it to switch over over against the spring force so that the supply of pump fluid to the control valve 14 for the lower priority servo motor 10 is interrupted. Consequently said servo motor 10 cannot be actuated. Furthermore, the control pressure also switches the changeover valve 22 so that the control pressure of the servo motor 1 reaches the connection X and thus acts on the regulating valve 32 (FIG. 1), 32' or (FIG. 2). In the manner already explained in accordance with FIG. 1 the pressure and delivery flow of the adjustment pump 25 are now adjusted so that the pump generates the necessary pressure. In the embodiment of FIG. 2 the pressure of the constant pump 25' is correspondingly increased.

The control valve 4 is also distinguished by the following particular features: the control slide member, is locked in an end position corresponding to the position in which the opening of the blade is directed upwardly electrically as indicated at 34. On the servo motor 1 or the blade actuated thereby a limit switch is provided so that when the desired end position of the blade is reached the control slide of the control valve 4 is unlocked. Such a limit switch is shown schematically in the figures as being associated with the servo motor 1 and is identified generally by the reference numeral 51. Its connection to the electric lock 34 is indicated by the broken line 52. Thus the control valve is automatically returned by the spring 35 to the neutral position in which the control pressure line 21 is again connected to the tank T so that the priority control valve 20 and the changeover valve 22 move to the illustrated position. Thus the control valve 14 is supplied with pump fluid for the lower priority servo motor and the working pressure obtaining at the servo motor is applied by the control pressure line 24 via the changeover valve 22 to the connection X for the pump regulation (FIG. 1) or load-pressure-dependent pressure regulation (FIG. 2).

The priority control means also has the advantage that the operation of picking up load material and raising the load is automated. This is because the control slides of both control valves 4 and 14 are moved together in one manipulation into the corresponding end position for initiating the picking-up and raising operation. The control valve 4 is first locked electrically and the control valve 14 mechanically whilst the flow to the control valve 14 is immediately interrupted. Thus, after picking up load material the appropriate blade adjustment is made. When the correct blade position is reached by the limit switch 51 the control valve 4 is electrically unlocked and returned to the neutral position. Thereafter and without further operator control the lifting operation for the blade by means of the lower priority servo motor 10 begins via the already opened control valve 14. The return of the control valve 14 to the neutral position is by hand when the necessary lifting height has been reached, whereupon the control valve 4 is actuated for tipping the load material by corresponding blade movement and this in turn results in the flow of fluid to the control valve 14 being interrupted so that the blade can no longer execute any undesirable vertical adjustment. Once the load material has been tipped out and when the control valve 4 is released it is automatically switched by the spring back into the neutral position so that the lowering operation of the blade can now be initiated by the control valve 14.

In the line 6*a* leading from the higher priority control valve 4 to the tank a check valve 38 opening in the direction of the tank connection T is disposed. The check valve 38 functions to prevent tank pressures caused by the lower priority load from acting via the tank line 6*a* and the control lines 21 on the adjustment of the priority control valve 20 and the changeover valve 22, thus effectively eliminating malfunctions of the control.

In the drawings the body of the control valve is shown by dot-dash lines so as to indicate how the elements are related to each other and how the ends of certain passages such as the passages 6*a*, 6*b*, and 5 are closed at their outer ends by the attached end plates. These closures are indicated by an X in the figures.

The external ports of the valve body are indicated by an O in the figures.

We claim:

1. A hydraulic priority control means for at least two servo motors having different priority values and supplied by a common fluid pump, consisting of a respective control valve for each servo motor each interposed in a line from the fluid pump and the associated servo motor, a priority control valve disposed in a line conducting the fluid pump output to the control valve of the lower priority servo motor, said respective control valves having a neutral position wherein no pressure is applied to the respective servo motor, a first end position for applying pressure on the respective servo motor in one direction and a second end position for applying pressure on the respective servo motor in a direction opposite to said one direction, means for applying the working pressure of the higher priority servo motor as a control pressure to the priority control valve for urging said priority control valve to a closed position including a control pressure line communicating with the control valve for the higher priority servo motor, a changeover valve, means for regulating fluid pump pressure including a pressure responsive valve, means for applying pressure from said changeover valve to said pressure responsive valve, deflection of the control valve for the higher priority servo motor out of the neutral position being effective to apply pressure through said control pressure line to said priority control valve in a direction to close communication of the pressure line leading to the control valve for the lower priority servo motor and switch said changeover valve from a position wherein the working pressure of the lower priority servo motor is applied to said pressure responsive valve to control the regulated pressure to a position wherein the control pressure is applied to said pressure responsive valve to control the regulated pressure.

2. Priority control means according to claim 1, characterized in that means are provided for opening of the pressure line leading to the control valve for the lower priority servo motor on return of the control valve for the higher priority servo motor into the neutral position by venting control pressure to tanks.

3. Priority control means according to claim 2, further including locking means for locking the control valve for the higher priority servo motor into a predetermined end position and means for automatically returning said higher priority servo motor control valve to the neutral position upon release of said locking means.

4. Priority control means according to claim 3, in that the means for returning the higher priority servo motor control valve including means for unlocking said locking means in reponse to the position of the higher priority servo motor.

5. Priority control means according to claim 4, characterized in that the locking means operates only in one working direction of the higher priority servo motor.

6. Priority control means according to claim 4, characterized in that the unlocking of the control valve is effected electrically.

7. Priority control means according to claim 1, characterized in that the pressure responsive valve of the means for regulating pump pressure is responsive in one direction to the control pressure in the control pressure line and in the opposite sense by the pressure in the pump pressure line.

8. Priority control means according to claim 1, characterized in that the priority control valve and the changeover valve are provided in a first valve block, a second valve block for the higher priority control valve being affixed to one side of said first valve block, and a third valve block for the lower priority control valve being affixed to the other side of said first valve block, through lines for the pump pressure, the control pressure and the line leading to the tank being provided in the valve blocks, the first valve block forming connections for the pump pressure line, the control pressure line and the line to the tank.

9. Priority control means according to claim 8, characterized in that the tank line leading to the higher priority control valve contains a check valve (38) opening in the direction of the tank.

10. A hydraulic priority control means as set forth in claim 1 wherein the means for regulating fluid pump pressure comprises a pressure regulating valve.

11. The apparatus as set forth in claim 1 wherein the fluid pump is a variable output pump and the fluid pressure is regulated by varying the output of said variable output pump.

* * * * *